US006756724B2

(12) United States Patent
Bae et al.

(10) Patent No.: US 6,756,724 B2
(45) Date of Patent: Jun. 29, 2004

(54) TENSION MASK FRAME ASSEMBLY OF COLOR PICTURE TUBE

(75) Inventors: Chul-han Bae, Seoul (KR); Nozomu Arimoto, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 226 days.

(21) Appl. No.: 09/902,155

(22) Filed: Jul. 11, 2001

(65) Prior Publication Data

US 2002/0005689 A1 Jan. 17, 2002

(30) Foreign Application Priority Data

Jul. 12, 2000 (KR) ..... 2000-39985

(51) Int. Cl.[7] ..... H01J 29/80
(52) U.S. Cl. ..... 313/407; 313/402
(58) Field of Search ..... 313/402–408

(56) References Cited

U.S. PATENT DOCUMENTS 3,638,063 A 1/1972 Tachikawa et al.
4,926,089 A 5/1990 Moore
4,942,332 A 7/1990 Adler et al.
4,973,283 A 11/1990 Adler et al.
5,394,051 A * 2/1995 Lerner ..... 313/403
5,523,647 A * 6/1996 Kawamura et al. ..... 313/407
5,672,935 A * 9/1997 Ito et al. ..... 313/406
6,372,058 B1 * 4/2002 Ono ..... 148/336
6,388,370 B1 * 5/2002 Ohmae ..... 313/403
2001/0020817 A1 * 9/2001 Inoue et al. ..... 313/461
2002/0014821 A1 * 2/2002 Kobayashi et al. ..... 313/402
2002/0117955 A1 * 8/2002 Chun et al. ..... 313/402

FOREIGN PATENT DOCUMENTS

JP 2000-77007 3/2000

* cited by examiner

*Primary Examiner*—Ashok Patel
*Assistant Examiner*—German Colón
(74) *Attorney, Agent, or Firm*—Robert E. Bushnell, Esq.

(57) ABSTRACT

A tension mask frame assembly of a color cathode-ray tube, the assembly including a tension mask including a plurality of parallel strips spaced at predetermined intervals apart from each other and a plurality of real bridges for connecting adjacent strips to each other to form slots through which electron beams pass, the number of real bridges gradually decreasing in a direction from the center portion of the mask to the peripheral portion thereof, a frame for supporting the tension mask so that a tensile force is applied to the tension mask in the direction of strips, and at least one damper which is installed on the frame and contact the strips of the tension mask.

26 Claims, 11 Drawing Sheets

TENSION MASK FRAME ASSEMBLY OF COLOR PICTURE TUBE

CLAIM OF PRIORITY

This application makes reference to, incorporates the same herein, and claims all benefits accruing under 35 U.S.C. §119 from an application entitled Tension-mask frame assembly for color picture tube earlier filed in the Korean Industrial Property Office on Jul. 12, 2000, and there duly assigned Ser. No. 2000-39985 by that Office.

BACKGROUND OF THE INVENTION

1. Field of the Invention

The present invention relates to color picture tubes, and more particularly, to a tension mask frame assembly for a color picture tube, which is installed adjacent to a fluorescent film in a panel and performs a color distinction function.

2. Description of the Related Art

In color picture tubes adopted in computer monitors and televisions, three electron beams emitted from an electron gun land on red, green and blue fluorescent materials on a fluorescent film, which is formed on the screen surface of a panel, through electron beam passing holes of a mask which has a color distinction function, and excite the fluorescent materials, where a picture is formed.

In the above-described color picture tubes for forming a picture, types of a mask having a color distinction function include a dot mask which is adopted in computer monitors and a slot mask (which is also called a slit mask) which is adopted in televisions. Since the screen surface of a panel is formed to have a predetermined curvature in consideration of the landing of deflected electron beams, dot masks and slot masks are designed to have a curvature corresponding to the curvature of the screen surface.

These masks are formed by etching a 0.1–0.25 mm (millimeters) thin plate, forming a plurality of electron beam pass holes and forming the thin plate in a predetermined curvature. If the mask has not a predetermined curvature or greater, the structural strength of the mask is weak. Thus, in many cases, this mask is permanently plastic-deformed during the manufacture of cathode-ray tubes or during the transportation of cathode-ray tubes. Consequently, this mask may not perform a color distinction function. However, a mask molded to have a predetermined curvature is supported by a frame and installed on the inner surface of a panel. The mask is easily heated and thermally expanded by thermal electrons emitted from an electron gun, and doming occurs, preventing color distinction of three electron beams.

Recent color picture tubes pursue flattening of a screen surface because the development of enlargement of color picture tubes causes distortion of a picture depending on the curvature of the screen surface and requires reproduction of natural pictures.

Slot masks for preventing the doming of a mask and flattening the screen surface of a panel have been disclosed in U.S. Pat. No. 3,638,063 for Grid Structure for Color Picture Tubes issued to Tachikawa et al., U.S. Pat. No. 4,942,332 for Tied Slit Mask for Color Cathode Ray Tubes issued to Adler et al., U.S. Pat. No. 4,926,089 for Tied Slit Foil Shadow Mask with False Ties issued to Moore and U.S. Pat. No. 4,973,283 for Method of Manufacturing a Tied Slit Mask CRT issued to Adler et al.

An aperture grille-type mask frame assembly includes strips spaced predetermined intervals apart from each other in parallel to form slots. Both ends of the strips are supported by a frame so that the mask has a tensile force. The strips are connected to each other by damper wires, in order to prevent the strips from vibrating independently.

However, the mask frame assembly is not easy to handle during the manufacture because of its structure in which the strips formed on a plate are parallel to each other and secured at only both ends thereof.

In order to solve this problem, a slot mask disclosed in U.S. Pat. No. 4,942,332 issued to Tachikawa et al. has a structure in which a plurality of strips are spaced predetermined intervals apart from each other on a thin plate to form slits and connected to adjacent strips by tie bars.

Since the strips of this mask are connected to each other by tie bars, howling vibration generated by external impacts and acoustic waves can be more or less reduced. But, the vibration of tie bars is transmitted between adjacent strips, so that the reduction of the howling is not large.

To solve this problem, a color cathode-ray tube is disclosed in Japanese Patent Publication No. 2000-77007 for Color Cathode-ray Tube by Watanabe. In this color cathode-ray tube there is a shadow mask on which a plurality of slots are formed is installed on a frame so that a tensile force is applied to the shadow mask. The frame includes a vibration damper which contacts the edge of the shadow mask.

The cathode-ray tube having such a structure dampens vibration by adhering the vibration damper to the shadow mask. However, the shadow mask is a thin plate through which slots are formed, and transmits vibration well via media for transmitting vibration, that is, via real bridges for defining slots, so that a sufficient amount of vibration cannot be dampened by the vibration damper 33 alone.

Another shadow mask frame assembly includes a frame, a mask and an earing. The mask is tensed and secured to the frame, and has strips spaced predetermined intervals apart from each other in parallel and a plurality of real bridges which connect the strips to each other to define the slots. The earing is hung through the end strip of the mask in order to dampen the vibration of the mask.

This mask frame assembly intends to extinguish a vibration applied to the mask using the friction of the end strip and the earing. However, the friction of the end strip and the earing creates noise. Also, the strips on the mask are connected to each other by a plurality of real bridges, so that vibrations are transmitted well via the bridges. Thus, although a vibration generated on the center portion of the mask is dampened by the earrings after being transmitted to the end strip, a sufficient vibration damping effect cannot be expected.

In this mask, scanning electron beams interfere with holes arranged on a mask, which causes a moire phenomenon. Since the spots of electron beams which land on a fluorescent film are deformed into horizontally-long spots by the strong pin cushion magnetic field of a deflection yoke as the deflection angle of electron beams increases, severe moire phenomenon occurs at the peripheral portion of a screen. Thus, selection of a mask pitch that minimizes the moire phenomenon and reduction of the vertical pitch of a mask to reduce the depth of modulation have been used.

These methods, by which the transmissivity of the peripheral portion of a mask is reduced, are not desirable in terms of the uniformity of the luminance of a screen.

Also, in the case of these masks, a mask domes severely by the heat from electron beams. Furthermore, the doming is prone to occur at the periphery of a mask. In the case of tension masks, if a cheap iron material is used, the masks including its bridge portion expand horizontally, a moire phenomenon occurs on the screen.

SUMMARY OF THE INVENTION

To solve the above problems, an objective of the present invention is to provide a tension mask frame assembly of a color cathode-ray tube, by which the transmission of vibration between strips is reduced, the vibration damping effect by the fraction of strips and damper wires is improved, the moire phenomenon due to the interference between electron beams and slots is prevented, and the luminance of pictures is improved.

It is another object to have a tension mask frame that produces a better image quality in a cathode-ray tube.

It is yet another object to have a tension mask that is easy to manufacture and does not increase the cost of manufacture.

To achieve the above objects, the present invention provides a tension mask frame assembly of a color cathode-ray tube, according to a first embodiment of the present invention, the assembly includes a tension mask including a plurality of parallel strips spaced at predetermined intervals apart from each other and a plurality of real bridges for connecting adjacent strips to each other to form slots through which electron beams pass, the number of real bridges gradually decreasing in a direction from the center portion of the mask to the peripheral portion thereof; a frame for supporting the tension mask so that a tensile force is applied to the tension mask in the direction of strips; and at least one damper which is installed on the frame and contact the strips of the tension mask.

In this embodiment of the present invention, the damper is made up of at least one damping Idea wire having both ends secured to the frame, the damping wire contacting each of the strips. Also, the damper can be made up of two damping wires, one end of which is secured to the mask and the other end is secured to the frame.

To further achieve the above objects, the present invention provides a tension mask frame assembly of a color cathode-ray tube, according to a second embodiment of the present invention, the assembly includes a mixed-type tension mask including a plurality of parallel strips spaced at predetermined intervals apart from each other, a real bridge region having real bridges for connecting adjacent strips to each other to form slots through which electron beams pass, the real bridge region being located at the center of the mask, and a dummy bridge region having a plurality of dummy bridges that extend from at least one strip of adjacent strips so that the extending strip does not mechanically contact the facing strip, the dummy bridge regions being located on the peripheral portion of the mask; a frame for supporting the tension mask so that a tensile force is applied to the tension mask; and at least one damper which is installed on the frame and contact the strips of the tension mask.

To further achieve the above objectives, the present invention provides a tension mask frame assembly of a color cathode-ray tube, according to a third embodiment of the present invention, the assembly including a tension mask of mixed type including a plurality of parallel strips spaced at predetermined intervals apart from each other, a real bridge region having real bridges for connecting adjacent strips to each other to form slots through which electron beams pass, the real bridge region being located at the center of the mask, a dummy bridge region having a plurality of dummy bridges that extend from at least one strip of adjacent parallel strips so that the extending strip does not mechanically contact the facing strip, the dummy bridge region being located at the outer side of the real bridge region, and an aperture grille region having a single slot defined by strips, the aperture grille region being located at the outer side of the dummy bridge region; a frame for supporting the tension mask so that a tensile force is applied to the tension mask; and at least one damper which is installed on the frame and contact the strips of the tension mask.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
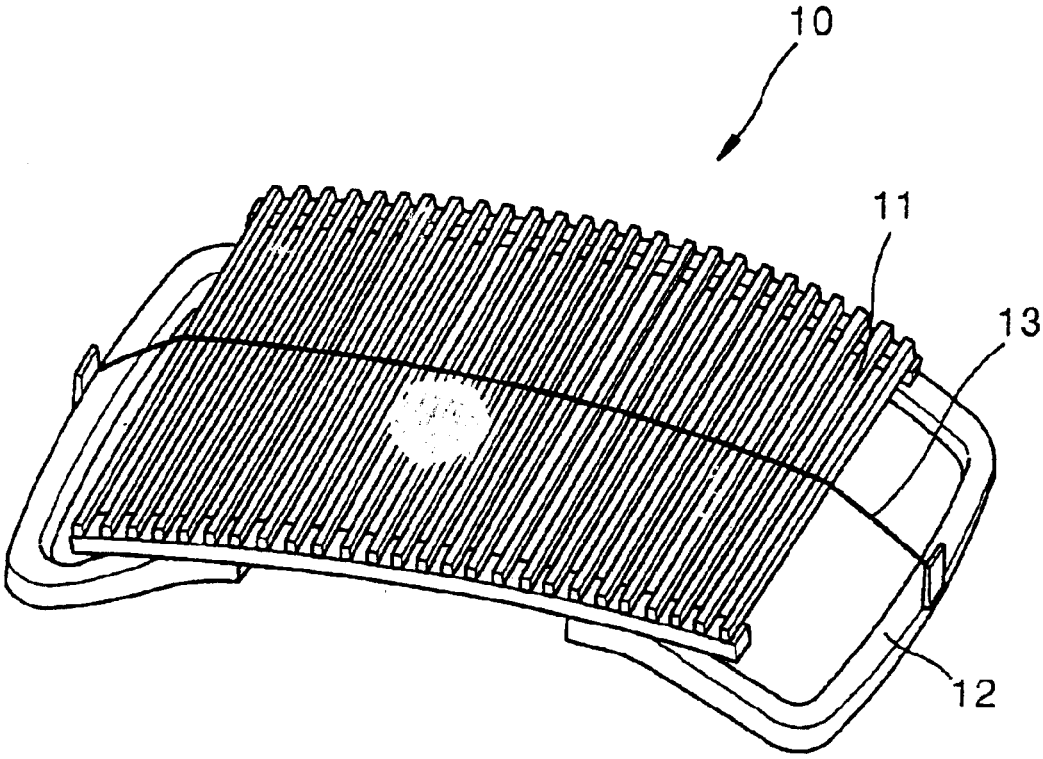
FIG. 1 (PRIOR ART)
FIG. 1 is a perspective view of a conventional tension mask assembly of a cathode-ray tube.

Turning now to the drawings, FIG. 1 shows a mask frame assembly of aperture grille type among the above-disclosed masks. As shown in FIG. 1, an aperture grille-type mask frame assembly 10 includes strips 11 spaced predetermined intervals apart from each other in parallel to form slots. Both ends of the strips 11 are supported by a frame 12 so that the mask has a tensile force. The strips 11 are connected to each other by damper wires 13, in order to prevent the strips from vibrating independently.

However, the mask frame assembly 10 is not easy to handle during the manufacture because of its structure in which the strips formed on a plate are parallel to each other and secured at only both ends thereof.

In order to solve this problem, a slot mask disclosed in U.S. Pat. No. 4,942,332 issued to Tachikawa et al. has a structure in which a plurality of strips are spaced predetermined intervals apart from each other on a thin plate to form slits and connected to adjacent strips by tie bars.

Since the strips of this mask are connected to each other by tie bars, howling vibration generated by external impacts and acoustic waves can be more or less reduced. But, the vibration of tie bars is transmitted between adjacent strips, so that the reduction of the howling is not large.

Figure 2:
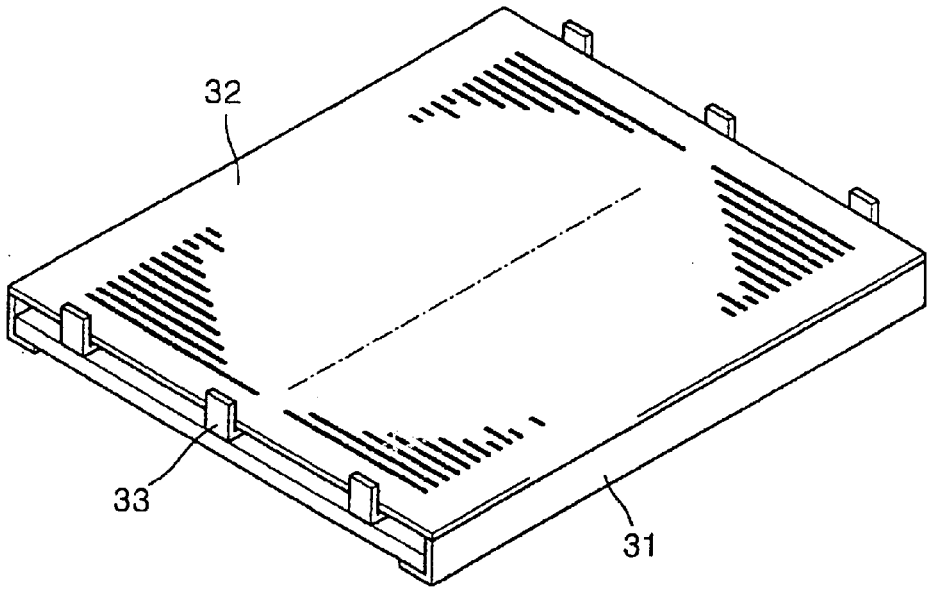
FIG. 2 (PRIOR ART)
FIG. 2 is a perspective view of a conventional tension mask assembly.

To solve this problem, a color cathode-ray tube is disclosed in Japanese Patent Publication No. 2000-77007 for Color Cathode-ray Tube by Watanabe. In this color cathode-ray tube shown in FIG. 2, a shadow mask 32 on which a plurality of slots (not shown) are formed is installed on a frame 31 so that a tensile force is applied to the shadow mask 32. The frame 31 includes a vibration damper 33 which contacts the edge of the shadow mask 32.

The cathode-ray tube having such a structure dampens vibration by adhering the vibration damper 33 to the shadow mask 32. However, the shadow mask is a thin plate through which slots are formed, and transmits vibration well via media for transmitting vibration, that is, via real bridges for defining slots, so that a sufficient amount of vibration cannot be dampened by the vibration damper 33 alone.

Figure 3:
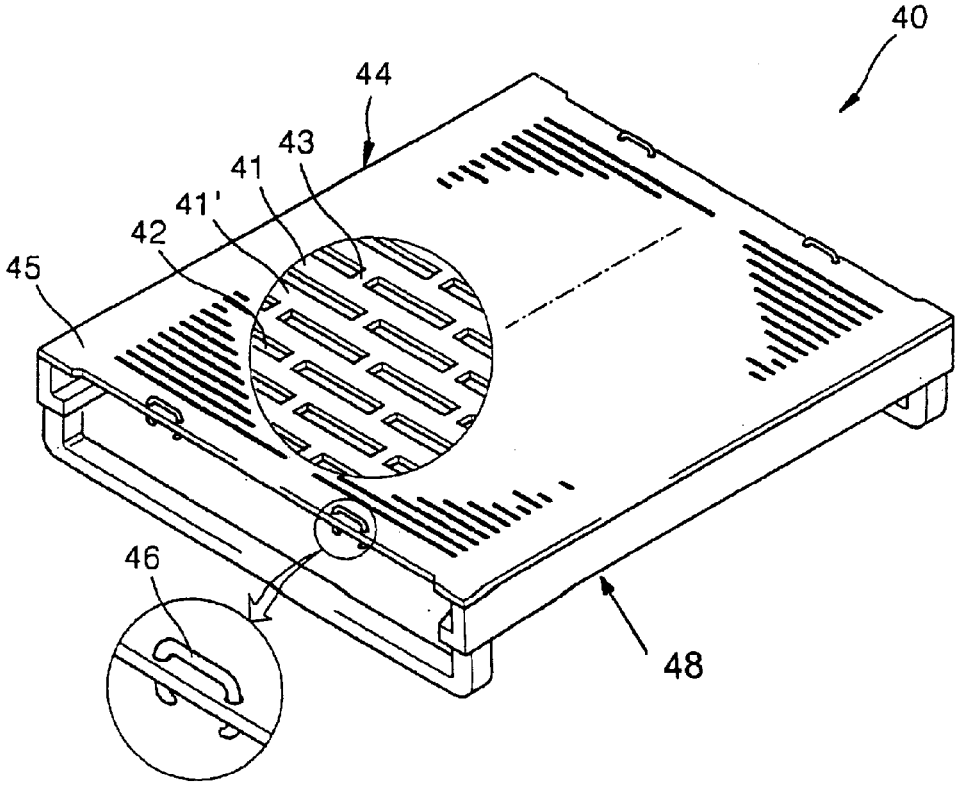
FIG. 3 is a perspective view of an earlier tension mask assembly.

FIG. 3 shows another example of an earlier shadow mask frame assembly. As shown in FIG. 3, a shadow mask frame assembly 40 includes a frame 48, a mask 44 and an earing 46. The mask 44 is tensed and secured to the frame 48, and has strips 41 and 41' spaced predetermined intervals apart from each other in parallel and a plurality of real bridges 43 which connect the strips 41 and 41' to each other to define slots 42. The earing 46 is hung through the end strip 45 of the mask 44 in order to dampen the vibration of the mask.

This mask frame assembly intends to extinguish a vibration applied to the mask using the friction of the end strip 45 and the earing 46. However, the friction of the end strip 45 and the earing 46 creates noise. Also, the strips on the mask are connected to each other by a plurality of real bridges, so that vibrations are transmitted well via the bridges. Thus, although a vibration generated on the center portion of the mask is dampened by the earrings 46 after being transmitted to the end strip, a sufficient vibration damping effect cannot be expected.

Figure 4:
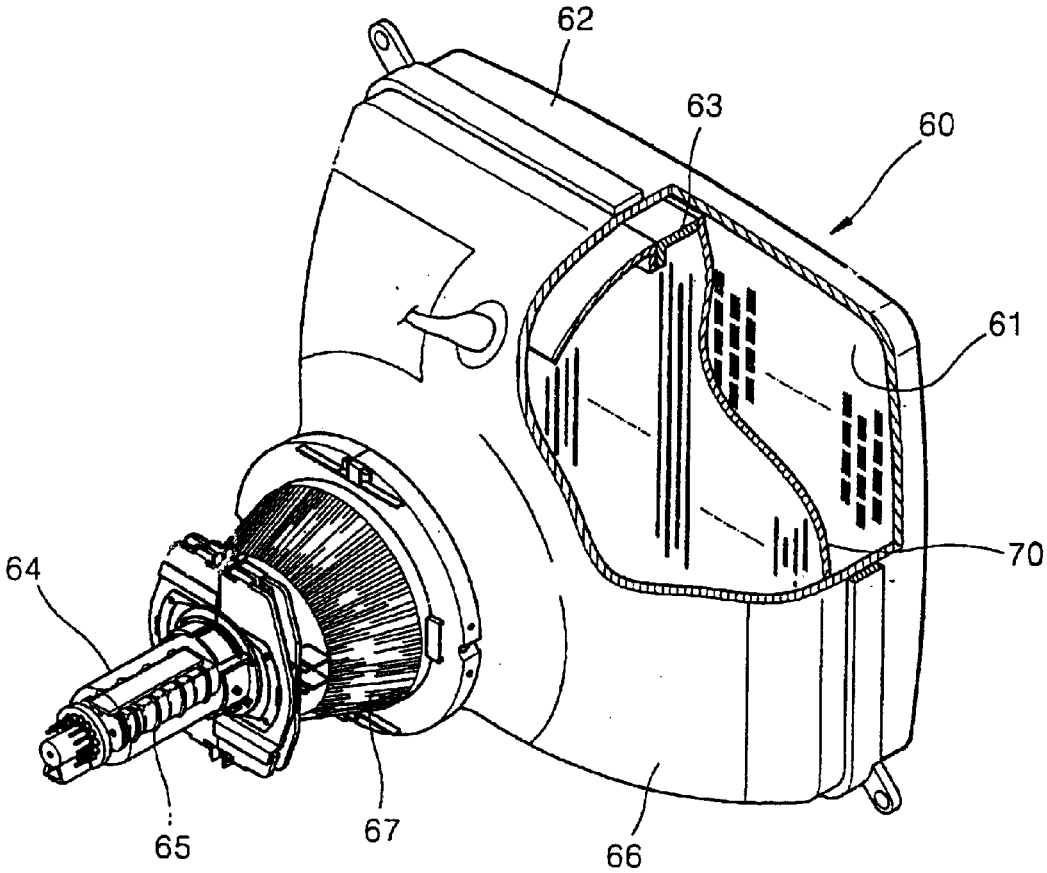
FIG. 4 is a perspective view of a cathode-ray tube in which a tension mask assembly according to the present invention is installed.

FIG. 4 is a perspective view of a cathode-ray tube in which a tension mask assembly according to the present invention is installed. As shown in FIG. 4, a color cathode-ray tube 60 includes a panel 62 on which a fluorescent film 61 having a predetermined pattern is formed, and a tension mask frame assembly 63 installed on the inner surface of the panel 62. The panel 62 meets with a funnel 66 having a neck portion 64 on which an electron gun 65 is installed, and a deflection yoke 67 for deflecting an electron beam emitted from the electron gun 65 to allow the electron beam to accurately land on a fluorescent film is installed on the neck portion 64 and a cone portion of the funnel 66.

Figure 5:
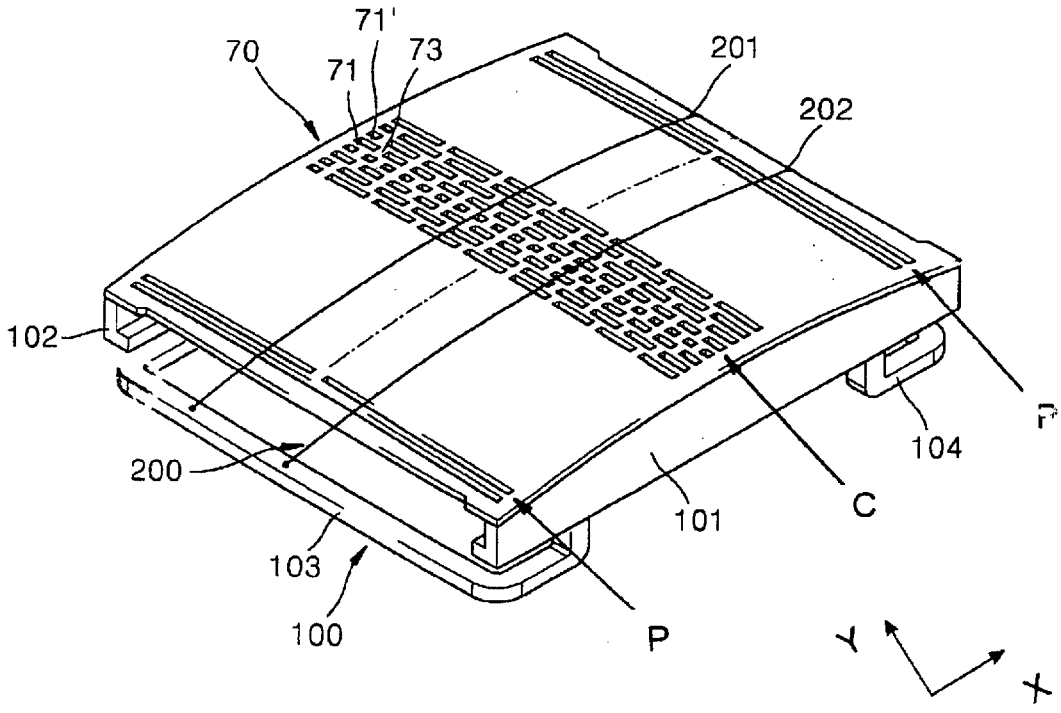
FIG. 5 is a perspective view of a tension mask assembly according to an embodiment of the present invention.

FIG. 5 is a perspective view of a tension mask assembly according to an embodiment of the present invention. As shown in FIG. 5, this tension mask assembly includes a frame 100, a mask 70 and a damper 200. The frame is made up of support members 101 and 102 isolated a predetermined interval apart from each other and elastic members 103 and 104 for supporting both ends of each of the support members 101 and 102. The facing longer sides of the mask 70 are supported by the support members 101 and 102, so that tension is applied to the mask 70. The damper 200 dampens the vibration of the mask 70. Preferably, the sides of the support members 101 and 102 by which a tension mask is supported are curved so that a tension mask having a tension by being welded to the support members 101 and 102 has a predetermined curvature.

Figure 6:
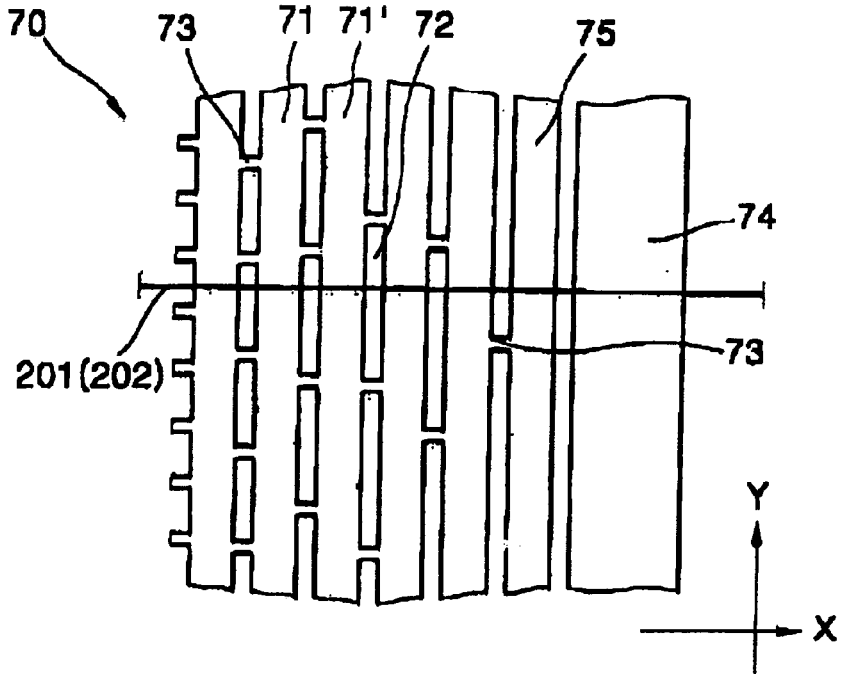
FIG. 6 is a plan view of another embodiment of the tension mask of FIG. 5.

The tension mask 70 is formed of a thin plate as shown in FIGS. 5 and 6, and has a plurality of strips 71 and 71' spaced predetermined intervals apart from each other in parallel and a plurality of real bridges 73 for connecting adjacent strips 71 and 71' to each other to define slots 72 through electron beams are passed. Here, the number of real bridges 73 gradually decreases in a direction from the center portion C of the tension mask to the peripheral portion P thereof. That is, the vertical pitch of the real bridge 73 gradually increases in the X-axis direction (in the horizontal direction perpendicular to the strips) from the center of the tension mask. The real bridges 73, the number of which decreases in the X-axis direction from the center portion of the tension mask, are randomly arranged to hinder the transmission of vibrations from the center portion or peripheral portion. Here, the number of real bridges decreases in a direction from the center of the tension mask to the periphery thereof, but the number of real bridges may be uniform without any decrease or increase over a certain region between the center portion and the peripheral portion.

In the tension mask, it is preferable that at least one real bridge is formed between the end strip 74 at the very end of the tension mask 70 in the X-axis direction and a strip 75 that is adjacent to the end strip 74, or no real bridges are formed therebetween.

Figure 7:
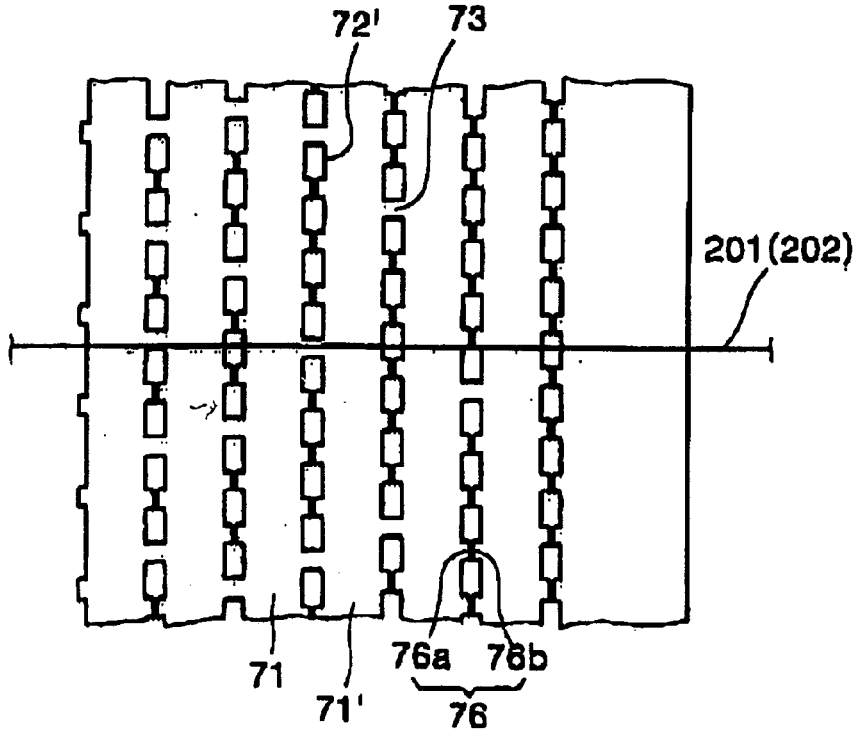
FIG. 7 is a plan view of another embodiment of the tension mask of FIG. 5.

The slots 72 can have dummy bridges. As shown in FIG. 7, slots 72' defined by the strips 71 and 71' and the real bridges 73 have a plurality of dummy bridges 76 made up of protrusions 76*a* and 76*b* that extend from the strips 71 and 71' in a facing direction and do not mechanically contact each other. The slots 72 of FIG. 6 and slots 72' of FIG. 7 differ in that slots 72' have dummy bridges 76. Alternatively, the dummy bridges 76 located on the slots 73 can be formed by extending from one strip.

Referring back to FIG. 5, both ends of the damper 200 are supported by the elastic members 103 and 104 of the frame 100, and the damper 200 includes damping wires 201 and 202 which contact the strips 71 and 71' of the mask 70.

Figure 8:
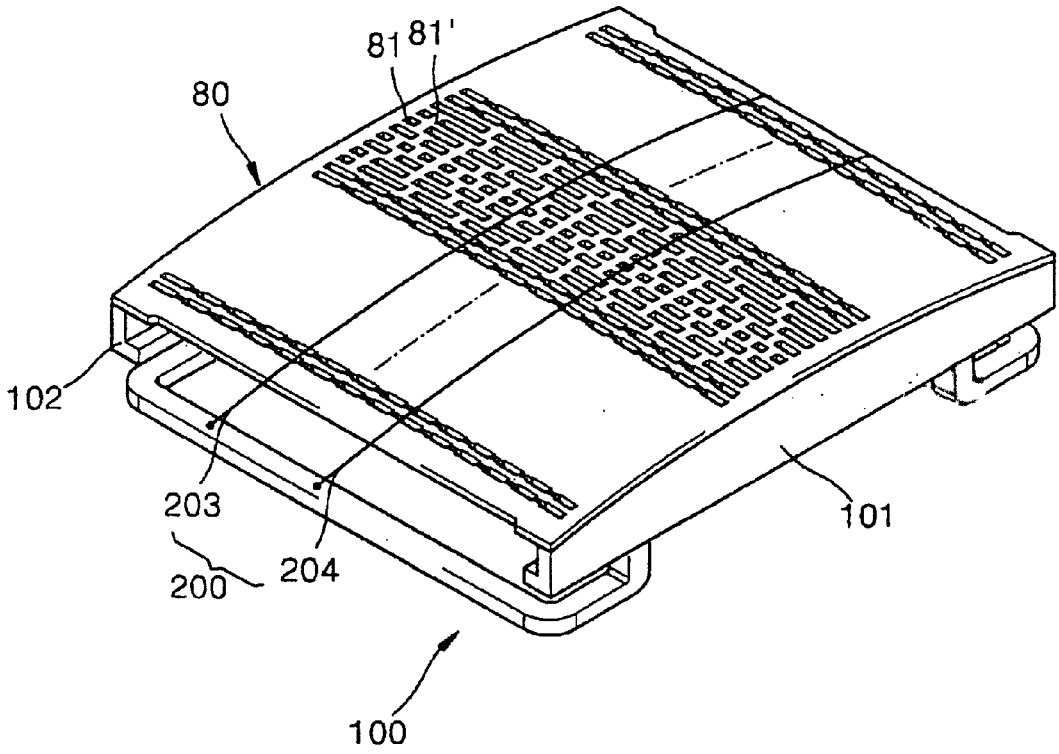
FIG. 8 is a perspective view of a tension mask assembly according to another embodiment of the present invention.

FIG. 8 is a perspective view of a tension mask assembly according to another embodiment of the present invention. The same reference numerals as those of the above-described embodiment denote the same elements.

As shown in FIG. 8, this tension mask assembly includes a frame 100, a tension mask 80 supported by the support members 101 and 102 of the frame 100 to be subjected to a tensile force, and a damper 200 supported by the frame and the mask for preventing the vibration of the mask.

Figure 9:
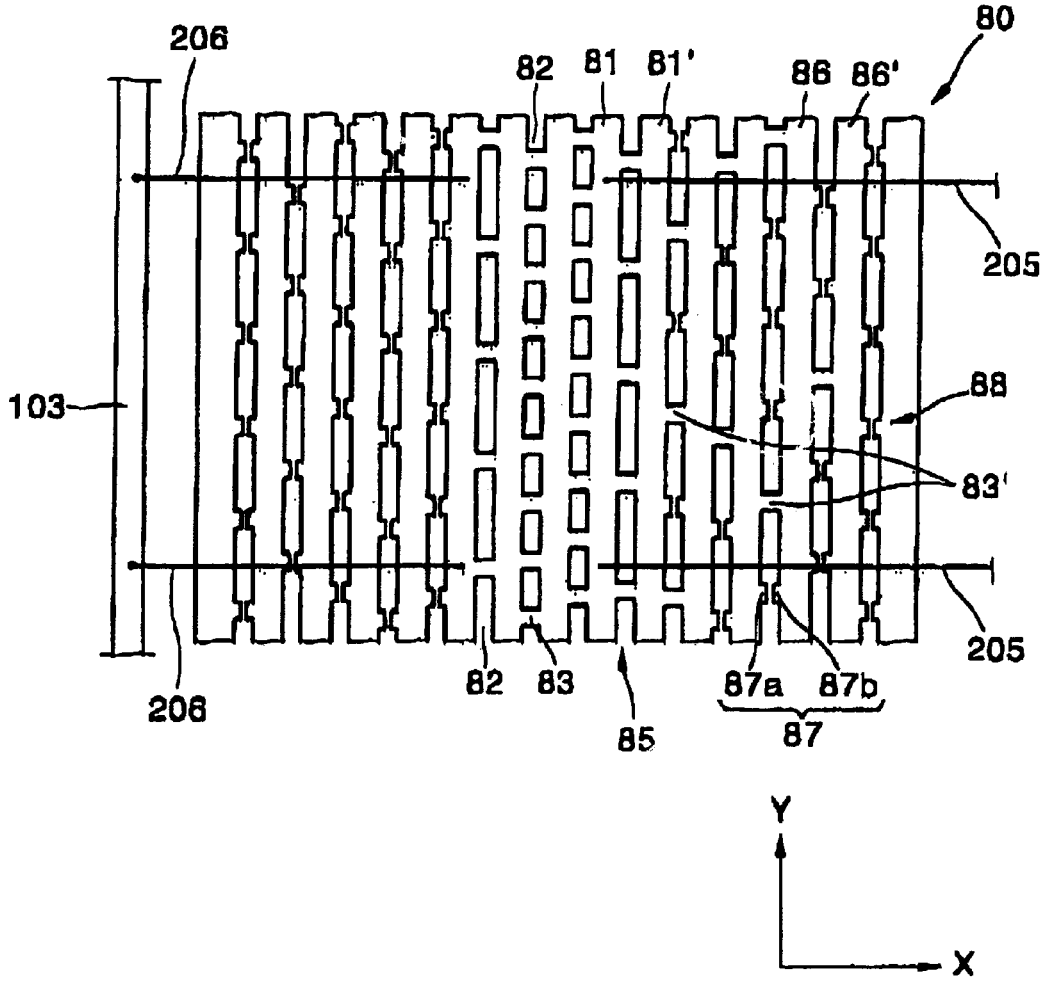
FIG. 9 is a plan view of another embodiment of the tension mask of FIG. 8.

As shown in FIGS. 8 and 9, the tension mask 80 includes a real bridge region 85 having a plurality of strips 81 and 81' spaced predetermined intervals apart from each other in parallel and a plurality of real bridges 83 for connecting the strips to each other to form slots 82 through which electron beams are passed. The tension mask 80 also includes a dummy bridge region 86 located on both sides of the slot region 85 in the X-axis direction. The dummy bridge region 88 includes strips 86 and 86' isolated from each other in parallel and a dummy bridge 87 made up of protrusions 87*a* and 87*a*' which extend from the edges of the strips 86 and 86' so as not to contact each other.

As shown in FIG. 9, real bridges 83' can be formed on the dummy bridge region 88 so that the number of real bridges decreases in an X-axis direction from the center of the real bridge region 85 to the peripheral portion thereof. Thus, the pitch of a real bridge gradually increases in a direction from the center of the tension mask 80 to the periphery thereof.

Figure 10:
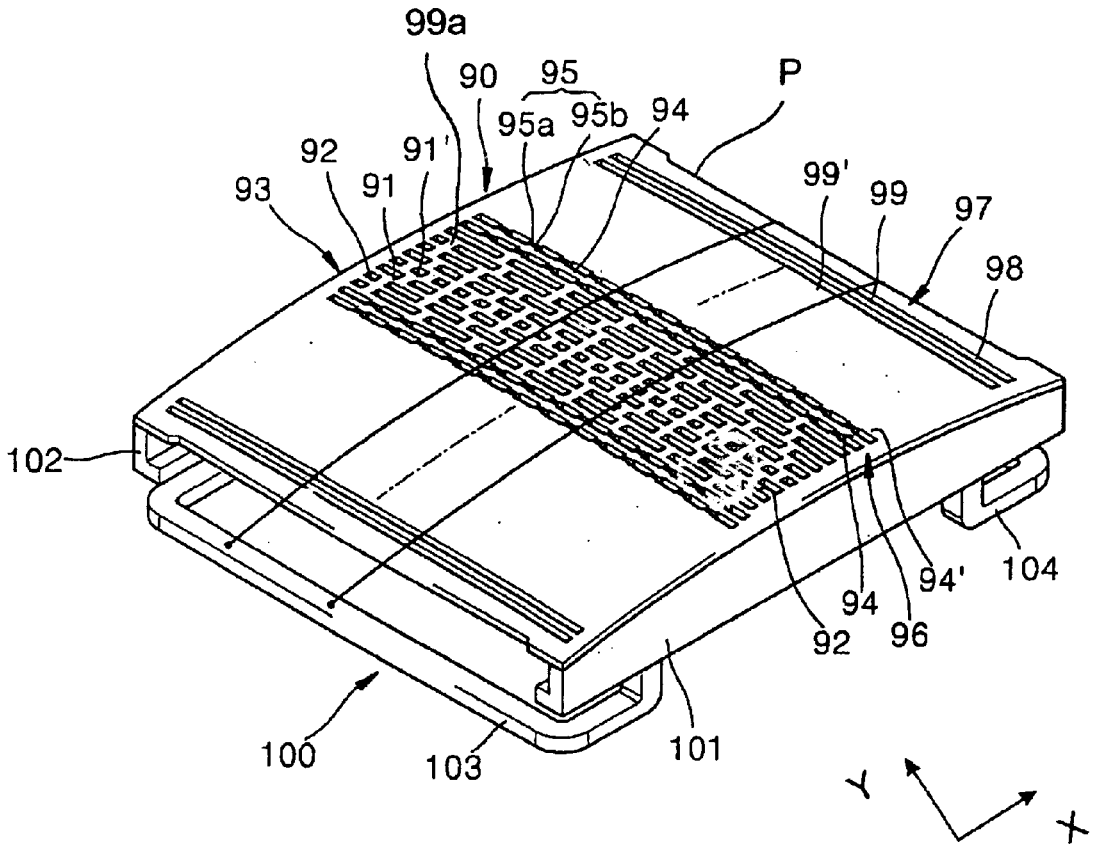
FIG. 10 is a perspective view of a tension mask assembly according to still another embodiment of the present invention.
Figure 11A:
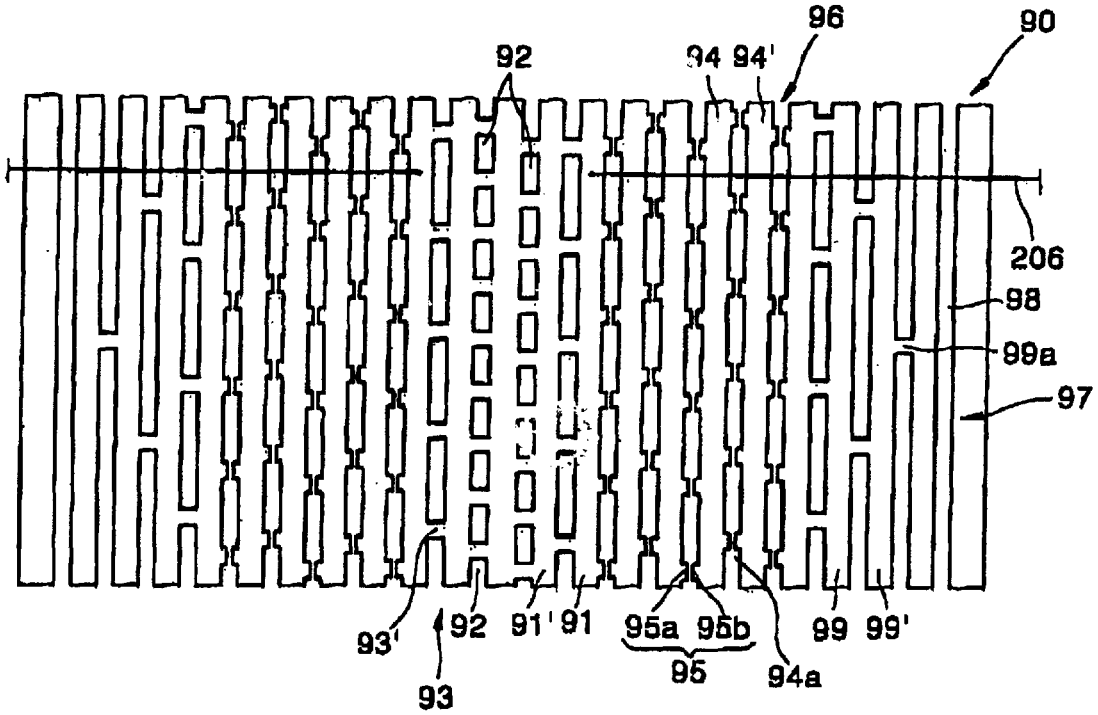
FIGS. 11A and 11B are plan views of another embodiment of the tension mask of FIG. 10.
Figure 11B:
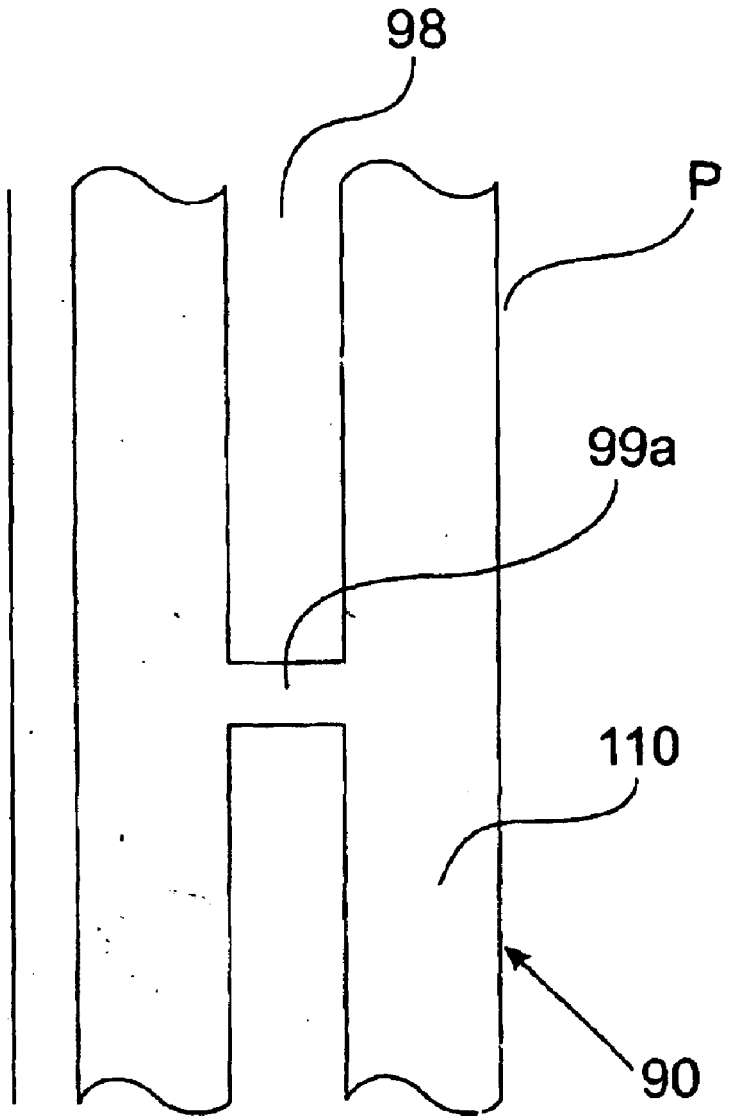

FIGS. 10, 11A, 11B are a perspective view and a plan view of a tension mask assembly according to still another embodiment of the present invention. As shown in FIG. 10, a mask 90 formed of a thin plate is a combination-type mask including a real bridge region 93 and a dummy bridge region 96. The real bridge region 93 has a real bridge 93'. The real bridge region 93 has a plurality of parallel strips 91 and 91' isolated at predetermined intervals from each other on the center portion of the mask 90, and real bridges 99*a* for connecting the strips to each other to form the slots 92 through which electron beams are passed. The dummy bridge region 96 has a plurality of parallel strips 94 and 94' isolated at predetermined intervals from each other on both sides of the real bridge region 93, and dummy bridges 95 each made up of protrusions 95*a* and 95*b* which extend from the strips 94 and 94' in a facing direction so that they do not mechanically contact each other. Here, the slot 94*a* is divided at an equal pitch by the pitch of the dummy bridge 95, and the protrusion can be formed by extending from one strip to the other strip instead of extending from adjacent strips in a facing direction. The dummy bridge region 96 can have real bridges (not shown in FIGS. 10 through 11B, but depicted in FIGS. 6 and 7) for connecting the strips 94 and 94'. In this case, the number of real bridges decreases in the X-axis direction from the region of the slots 92. An aperture grille region 97 is formed on the outside of the dummy bridge region 96, and includes strips 99 and 99' installed in parallel to form a single slot 98. As shown in FIG. 11A, the strips 99 and 99' which form the aperture grille region 97 can be connected to each other by real bridges 99*a*. In this case, the number of real bridges 99*a* decreases in a direction toward the outside, and at least one real bridge 99*a* is formed between the end strip 110 at the periphery P of the mask 90 and a strip adjacent to the end strip, or no real bridges are formed therebetween.

As shown in FIGS. 8 and 10, the damper 200 is made up of the damping wires 203 and 204 that contact the strips 81 and 81' of the real bridge region 85 and the strips 94 and 94' of the dummy bridge region 96. Both ends of the damping wires 203 and 204 are secured to the elastic members 103 and 104 of the frame 100. The damping wires can be welded anywhere in the real bridge region. As shown in FIGS. 9 and 11A, another embodiment of the damper 200 includes first and second damping wires 205 and 206. One end of the first damping wire 205 is welded to the real bridge region 85 of the mask, and the other end is welded to the elastic member 104 of the frame 100. One end of the second damping wire 206 is welded to the real bridge region 85 of the mask, and the other end is welded to the elastic member 103 of the frame 100. The damping wires are not connected but really contact the strips.

The operation of the color cathode-ray tube tension mask frame assembly having such a structure will now be described. As shown in FIG. 5, the number of real bridges 73 for connecting the strips 71 and 71' decreases in a direction from the center C to the periphery P, that is, in the X-axis direction, thus damping the amount of impact vibration on the mask 70 transmitted to an adjacent strip. Also, the damping wires of the damper 200 are connected to the strips 71 and 71' of the tension mask 70, so that the damping efficiency of vibration on the mask created by impacts can be increased.

To be more specific, in a conventional tension mask, the number of real bridges for connecting strips is the same at the center portion of the tension mask as at the peripheral portion thereof, so that vibration transmission such as vibration transmission performed on a thin plate is accomplished. However, in the mask 70 according to the present invention, as the number of real bridges 73 decreases in a direction from the center of the mask to the periphery thereof, the number of media for transmitting vibration also decreases. Therefore, the amount of vibration transmitted from the center to the periphery or from the periphery to the center can be reduced. Also, undamped vibration is dampened by the contact friction between the damping wires 201 and the strips 71 and 71'.

As shown in FIG. 7, a slot 72' partitioned by the real bridges 73 has a dummy bridge 76 made up of protrusions 76*a* and 76*b* that extend from adjacent strips 71 and 71' in a facing direction so that they do not mechanically contact each other. Thus, the mask frame assembly according to the present invention can improve affirmation. To be more specific, the real bridges 73 block electron beams emitted from an electron gun, and are installed in an irregular arrangement that the number of real bridges decreases in a direction from the center of the mask to the periphery thereof, so that they appear as black spots on a screen. Also, dummy bridges are installed on the slots, so that the distribution of bridges is even over the entire surface of a screen. Thus, the real bridges that appear as black spots cannot be realized by viewers.

As shown in FIGS. 8 through 11B, when the color cathode-ray tube mask 80 is divided into the real bridge region 85 and the dummy bridge region 88, and when the color cathode-ray tube mask 90 is divided into the real bridge region 93, the dummy bridge region 96 and the aperture grille region 97, the transmission of vibration can be further dampened. That is, the strips 94 and 94' and the strips 99 and 99' are separately formed on the dummy bridge region 88 or 96 and the aperture grille region 97, respectively, so that vibration is prevented from being transmitted between the strips. An independent vibration created on the independently-formed strips is dampened by the friction with the damping wires 203 and 204 that are supported by the frame and connected to the independent strips. In particular, as shown in FIGS. 9 and 11A, a damper is made up of first and second damping wires 205 and 206, one end of which is secured to the real bridge region of the tension mask and the other end is secured to the frame, so that the strips on the dummy bridge region are connected to the strips on the aperture grille region by the first and second damping wires 205 and 206. Thus, an independent vibration of the strips can be prevented. The real bridge area (region) means an area encompassing real bridges and the strips where real bridges are formed. Likewise, the dummy bridge area (region) means an area encompassing dummy bridges and the strips where dummy bridges are formed.

Also, since the aperture grille region 97 has a single slot 98, clamping due to the deflection of electron beams can be reduced. Also, the aperture grille region 97 prevents electron beams from being blocked by the real bridges 93 and the dummy bridges 95, thereby improving the luminance at the peripheral portion of a screen. This improvement of luminance can minimize the clamping of electron beams caused by a decrease in the incident angle of electron beams when the electron beams are deflected to the peripheral portion of a fluorescent film by a deflection yoke. Furthermore, the number of real bridges that connect the strips decreases in a direction from the center portion of the mask to the peripheral portion thereof, so that the real bridges can reduce the degree of doming caused by the thermal expansion of the mask when the mask is heated by electron beams emitted from an electron gun.

Figure 12:
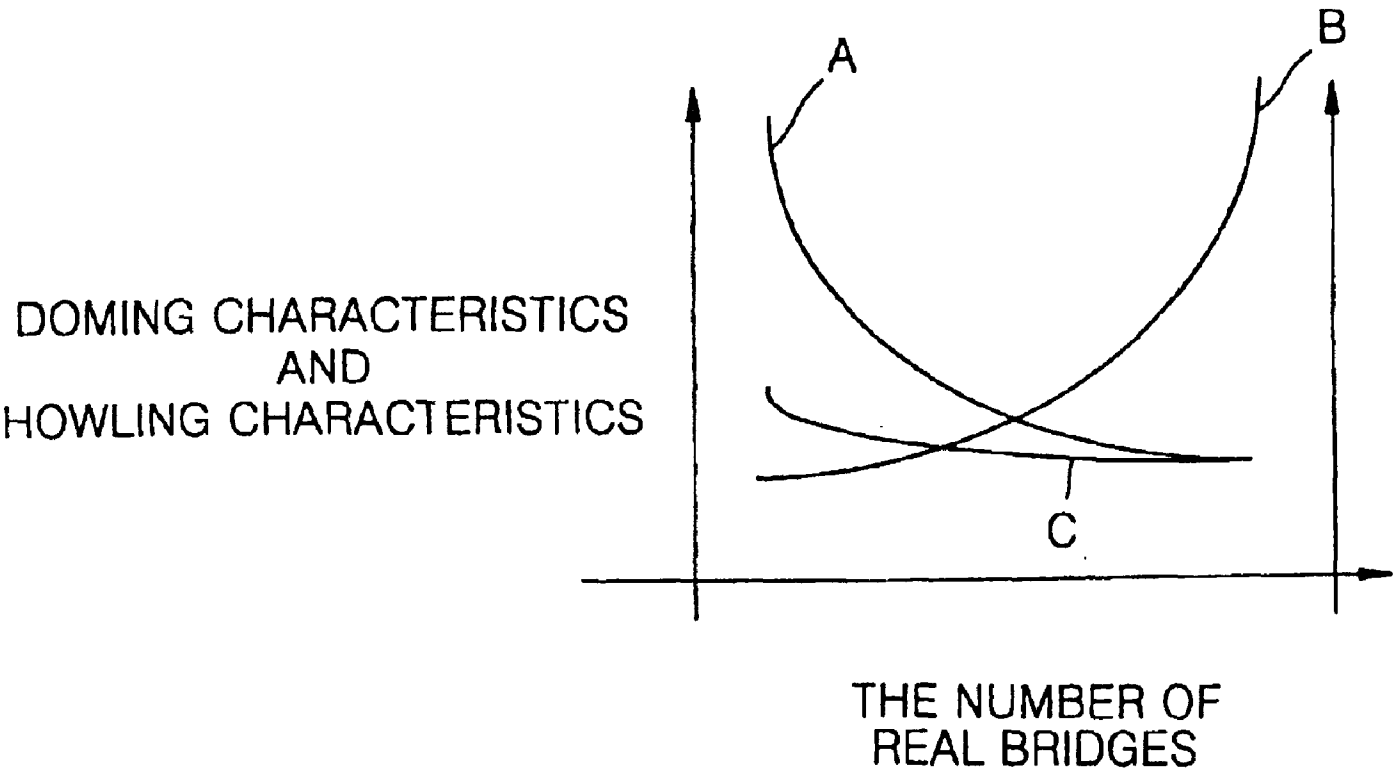
FIG. 12 is a graph showing a comparison of a variation in the howling characteristics and the doming characteristics with respect to the number of real bridges in the case of a tension mask according to the present invention with that in the case of an earlier mask.

The present inventor obtained the graph of FIG. 12 by measuring the howling characteristics and the doming characteristics of a tension mask in the tension mask frame assembly having such a structure installed in a cathode-ray tube.

As shown in FIG. 12, as the number of real bridges increases in a conventional mask, howling phenomenon decreases as indicated by reference character A, and doming phenomenon increases as indicated by reference character B. However, in the case of a mask according to the present invention, as the number of real bridges for connecting strips to each other decreases in the X-axis direction, the doming phenomenon and howling phenomenon significantly decrease as indicated by reference character C, compared to a conventional mask.

A tension mask according to the present invention has real bridges, the number of which decreases from the center portion of the mask to the peripheral portion thereof, thereby reducing Poisson contraction caused by a tensile force applied when the tension mask is installed on a frame. In the described tension mask frame assembly of a color cathode-ray tube according to the present invention, the number of real bridges decreases in a direction from the center of a tension mask to the periphery thereof. Thus, the damping effect of vibration transmission can be improved, and moire phenomenon due to the interference between the pattern formed by the real bridges and dummy bridges and the pattern of a fluorescent film can be reduced.

Although the invention has been described with reference to a particular embodiment, it will be apparent to one of ordinary skill in the art that modifications of the described embodiment may be made without departing from the spirit and scope of the invention. For example, the pattern of electron pass holes in a mask can be formed by the combination of a real bridge region, a dummy bridge region and an aperture grille region.

What is claimed is:

1. A tension mask frame assembly of a color cathode-ray tube, comprising:

a tension mask including a plurality of parallel strips spaced at predetermined intervals apart from each other and a plurality of real bridges connecting adjacent strips to each other to form slots through which electron beams pass, the number of real bridges decreasing in a direction from the center portion of said tension mask to the peripheral portion of said tension mask;

a frame for supporting said tension mask accommodating a tensile force applied to said tension mask in the direction of the strips; and at least one damper installed on the frame and contact the strips of the tension mask.

2. The tension mask frame assembly of a color cathode-ray tube of claim 1, said damper comprising of at least one damping wire having both ends secured to said frame, said damping wire contacting each one of said strips.

3. The tension mask frame assembly of a color cathode-ray tube of claim 1, said damper being made up of two damping wires, one end being secured to said tension mask and the other end being secured to said frame.

4. The tension mask frame assembly of a color cathode-ray tube of claim 1, the number of real bridges connecting with an end strip being at most one, said end strip being horizontally at the outermost side of said tension mask and adjacent to a strip of said tension mask.

5. The tension mask frame assembly of a color cathode-ray tube of claim 1, with a plurality of dummy bridges extending from adjacent strips in a facing direction accommodating no contact with each other being installed between two real bridges for connecting strips.

6. The tension mask frame assembly of a color cathode-ray tube of claim 5, said damper comprising of at least one damping wire having both ends secured to said frame, said damping wire contacting each one of said strips.

7. The tension mask frame assembly of a color cathode-ray tube of claim 5, said damper being made up of two damping wires, one end being secured to said tension mask and the other end being secured to said frame.

8. The tension mask frame assembly of a color cathode-ray tube of claim 1, with said tension mask further comprising a dummy bridge region including a plurality of dummy bridges extending from at least one strip of adjacent strips accommodating the dummy bridges extending from the one strip of adjacent strips to not contact another strip of the adjacent strips facing the dummy bridges.

9. The tension mask frame assembly of a color cathode-ray tube of claim 8, said damper comprising of at least one damping wire having both ends secured to said frame, said damping wire contacting each one of said strips.

10. The tension mask frame assembly of a color cathode-ray tube of claim 8, said damper being made up of two damping wires, one end being secured to said tension mask and the other end being secured to said frame.

11. The tension mask frame assembly of a color cathode-ray tube of claim 8, the strips having the dummy bridge regions further comprising real bridges.

12. The tension mask frame assembly of a color cathode-ray tube of claim 1, with said tension mask further comprising an aperture grille region including a single slot defined by strips, said aperture grille region being disposed toward the periphery of the tension mask.

13. The tension mask frame assembly of a color cathode-ray tube of claim 12, said damper comprising of at least one damping wire having both ends secured to said frame, said damping wire contacting each one of said strips.

14. The tension mask frame assembly of a color cathode-ray tube of claim 12, said damper being made up of two damping wires, one end being secured to said tension mask and the other end being secured to said frame.

15. The tension mask frame assembly of a color cathode-ray tube of claim 1, with the number of real bridges decreasing in an X-axis direction, the X-axis being perpendicular to the length of the strips of said tension mask.

16. A tension mask frame assembly of a color cathode-ray tube, comprising:

a tension mask of mixed type including a plurality of parallel strips spaced at predetermined intervals apart from each other, a real bridge region having real bridges for connecting adjacent strips to each other to form slots accommodating electron beams pass to pass through, the real bridge region being located at the center of said tension mask, and a dummy bridge region having a plurality of dummy. bridges extending from at least one strip of adjacent strips accommodating an extending strip to not mechanically contact a facing strip, the extending strip being the one strip of adjacent strips extending the dummy bridges and the facing strip being the other adjacent strip facing the extending strip, the dummy bridge region being located on the peripheral portion of said tension mask;

a frame supporting said tension mask accommodating a tensile force being applied to said tension mask; and at least one damper being installed on said frame and contacting the strips of said tension mask.

17. The tension mask frame assembly of a color cathode-ray tube of claim 16, said damper comprising of at least one damping wire having both ends secured to said frame, said damping wire contacting each of said strips.

18. The tension mask frame assembly of a color cathode-ray tube of claim 16, said damper comprising of at least one damping wire having both ends secured to said frame, said damping wire contacting at least one of said strips.

19. The tension mask frame assembly of a color cathode-ray tube of claim 16, said damper being made up of two damping wires, one end of damping wires being secured to said tension mask and the other end being secured to said frame.

20. The tension mask frame assembly of a color cathode-ray tube of claim 16, with said dummy bridge region further comprising real bridges for connecting adjacent strips to each other, the number of real bridges gradually decreases in a direction from the center of said tension mask to the periphery of said tension mask.

21. A tension mask frame assembly of a color cathode-ray tube, comprising:

a tension mask of mixed type including a plurality of parallel strips spaced at predetermined intervals apart from each other, a real bridge region having real bridges connecting adjacent strips to each other to form slots through which electron beams pass, the real bridge region being located at the center of said tension mask, a dummy bridge region having a plurality of dummy bridges extending from at least one strip of adjacent parallel strips accommodating an extending strip to not mechanically contact a facing strip, the extending strip being the one strip of adjacent parallel strips extending the dummy bridges and the facing strip being the other adjacent parallel strip facing the extending strip, said dummy bridge region being located at the outer side of said real bridge region, and an aperture grille region having a single slot defined by strips, said aperture grille region being located at the outer side of said dummy bridge region;

a frame supporting said tension mask to accommodate a tensile force being applied to said tension mask; and at least one damper being installed on said frame and contacting the strips of said tension mask.

22. The tension mask frame assembly of a color cathode-ray tube of claim 21, said damper comprising of at least one damping wire with both ends being secured to said frame, said damping wire contacting each of said strips.

23. The tension mask frame assembly of a color cathode-ray tube of claim 21, said damper comprising of two damping wires, one end of said damping wires being secured to said tension mask and the other end being secured to said frame.

24. The tension mask frame assembly of a color cathode-ray tube of claim 21, with the strips in said dummy bridge region being connected to each other by real bridges.

25. The tension mask frame assembly of a color cathode-ray tube of claim 21, with the number of real bridges for connecting adjacent strips to each other gradually decreases in a direction from the center of said real bridge region to the periphery of said dummy bridge region.

26. The tension mask frame assembly of a color cathode-ray tube of claim 24, with the strips in the aperture grille region being connected to each other by real bridges.

* * * * *